United States Patent [19]

Luitjen

[11] Patent Number: 4,712,346

[45] Date of Patent: Dec. 15, 1987

[54] METHOD FOR LAYING BRICKS IN A HERRINGBONE PATTERN, AND AN ACCORDINGLY MANUFACTURED BRICK STRUCTURE

[75] Inventor: Arend Luitjen, Mercuriusstraat 2, 3204 BM Spijkenisse, Netherlands

[73] Assignees: Arend Luijten, Spijkenisse; Robert de Vries, The Hague, both of Netherlands; a part interest to each

[21] Appl. No.: 863,138

[22] Filed: May 14, 1986

[30] Foreign Application Priority Data

May 15, 1985 [NL] Netherlands ..... 8501399

[51] Int. Cl.[4] ..... E04C 1/00; E01C 5/06

[52] U.S. Cl. ..... 52/311; 52/590

[58] Field of Search ..... 52/311, 590, 612, 561

[56] References Cited

FOREIGN PATENT DOCUMENTS 289918 7/1953 Switzerland ..... 52/590

OTHER PUBLICATIONS

Dutch Art Book, "Description of Early Roman Opus Spicatum", pp. 28, 31, 32, 35 & 37–40 relied upon.

Adeline's Art Dictionary, D. Appleton & Company, 1891, p. 200 relied upon.

Sweet's Catalog 1981, pp. 3 & 4, 1st relied upon.

*Primary Examiner*—J. Karl Bell

*Attorney, Agent, or Firm*—Lester Horwitz

[57] ABSTRACT

In accordance with the present invention there is provided an elevated brick structure, wherein the bricks are arranged in a herringbone pattern of alternate herringbone layers in which the bricks are either in a horizontally stretched position or in an upstanding position.

1 Claim, 1 Drawing Figure

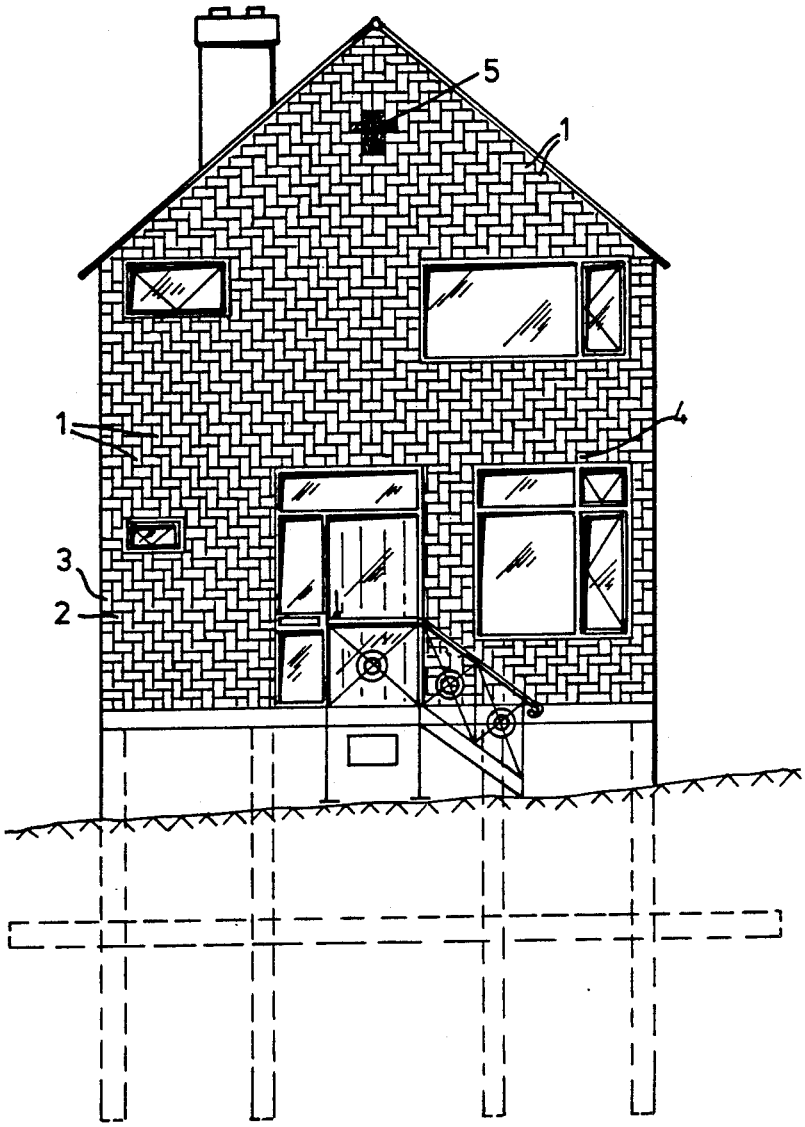
5
1
1
4
3
2

METHOD FOR LAYING BRICKS IN A HERRINGBONE PATTERN, AND AN ACCORDINGLY MANUFACTURED BRICK STRUCTURE

This invention relates to a method for laying bricks in a herringbone pattern, and an accordingly manufactured brick structure.

Until now bricks in a herringbone pattern are laid in a horizontal plane, but according to the present invention bricks are laid in a herringbone pattern to build an erected structure such as a wall, in which elevated herringbone pattern the bricks are either in a horizontally stretched position or in a vertical upstanding position so as to form a brick structure in "opus spicatum ascensum in murum" as depicted in the attendant drawing, wherein the herringbone layers are sloped at an angle of 45°.

In a wall structure as defined the herringbone pattern has the advantage that the lateral strength of the wall in its own plane is substantially increased due to the interweaved brick arrangement or in other words interlocking or interengaging brick abutment, compared to the common wall structure comprising horizontal brick layers only.

In the drawing the herringbone layers are indicated at 1, horizontally laid bricks at 2, and upstanding bricks at 3.

In a one-stone wall the bricks 5 which would seen half-stones in the drawing are in fact uncut bricks which are transversally laid, interconnecting two adjoining herringbone arrays, so that in fact very little cutting of bricks is required.

Such a herringbone pattern of bricks can also be prefabricated in panels which are to be intermeshed when assembled to a desired structure.

Besides its rigidity this novel structure has a nice, quite regular appearance.

Herringbone layers 1 sloping towards one another from opposite sides can be joined by a central saddle column as indicated at 5.

For regular work in a herringbone structure wherein the herringbone layers do not deviate from their predetermined slanted course, each square brick part is to be accommodated in a square measuring $(bw+jw)\sqrt{2}$ wherein bw is the brick width and jw the joint width.

Having thus described the invention what is claimed is:

1. An elevated brick structure, wherein the bricks are arranged in a herringbone pattern of alternate herringbone layers in which rectangular bricks are either in a horizontally stretched position or in an upstanding position forming twilled rows of bricks at an incline of 45°.

* * * * *